US007870816B1

(12) United States Patent
Willingham et al.

(10) Patent No.: US 7,870,816 B1
(45) Date of Patent: Jan. 18, 2011

(54) CONTINUOUS ALIGNMENT SYSTEM FOR FIRE CONTROL

(75) Inventors: Michael R. Willingham, Fort Worth, TX (US); Robert J. McCarty, Jr., Plano, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 526 days.

(21) Appl. No.: 11/828,815

(22) Filed: Jul. 26, 2007

Related U.S. Application Data

(63) Continuation of application No. 11/675,419, filed on Feb. 15, 2007, now abandoned.

(60) Provisional application No. 60/773,531, filed on Feb. 15, 2006.

(51) Int. Cl.
*F41G 3/14* (2006.01)

(52) U.S. Cl. ..... 89/204

(58) Field of Classification Search ..... 89/41.17, 89/204

See application file for complete search history.

(56) References Cited

U.S. PATENT DOCUMENTS

| | | | | |
|---|---|---|---|---|
| 4,760,397 | A | 7/1988 | Piccolruaz | 342/75 |
| 4,783,744 | A | 11/1988 | Yueh | 364/454 |
| 4,787,291 | A * | 11/1988 | Frohock, Jr. | 89/41.22 |
| 5,214,433 | A | 5/1993 | Alouani et al. | 342/95 |
| 5,431,084 | A * | 7/1995 | Fowler et al. | 89/41.21 |
| 5,483,865 | A | 1/1996 | Brunand | 89/41.21 |
| 6,038,955 | A * | 3/2000 | Thiesen et al. | 89/41.17 |
| 6,043,867 | A | 3/2000 | Saban | 356/5.01 |
| 6,532,433 | B2 * | 3/2003 | Bharadwaj et al. | 702/182 |
| 7,266,042 | B1 | 9/2007 | Gent et al. | 367/118 |
| 7,626,538 | B2 | 12/2009 | Rose | 342/195 |

OTHER PUBLICATIONS

T. T. Tay et al., "High Performance Control", pp. 104-105 (1997).
Dustin Deneault, "Tracking Ground Targets with Measurements Obtained from a Single Monocular Camera Mounted on an Unmanned Aerial Vehicle," pp. 4, 12-21, 42-43, 46-48, and 113 (2007).
Eric W. Frew, "Trajectory Design for Target State Estimation Using Monocular Vision", downloaded from http://recuv.colorado.edu/~frew/trajdesign.html, and last updated Nov. 20, 2007.
Eric W. Frew et al., "Adaptive Planning Horizon Based on Information Velocity for Vision-Based Navigation", AIAA Guidance, Navigation and Control Conference and Exhibit, pp. 17-18 (2007).
Eric W. Frew et al., "Trajectory Generation for Constant Velocity Target Motion Estimation Using Monocular Vision", pp. 1-3.

* cited by examiner

*Primary Examiner*—Stephen M Johnson
(74) *Attorney, Agent, or Firm*—Williams, Morgan & Amerson, P.C.

(57) ABSTRACT

In a first aspect, an automated method for engaging a target comprises: slewing a weapon to an estimated target state; and aligning the weapon's boresight with the actual target state. Aligning the weapon's boresight with the actual target state includes designating the target to obtain the actual target state; and zeroing an offset between the actual target state and the estimated target state. In a second aspect, an apparatus, comprises: means for slewing a weapon to an estimated target state; and means aligning the weapon's boresight with the actual target state. The aligning means includes designating the target to obtain the actual target state; and zeroing an offset between the actual target state and the estimated target state. In a third aspect, a weapon system comprises: a targeting sensor capable of designating a target; a weapon; and an alignment sensor associated with the weapon, and capable of receiving the designation and aligning the weapon's boresight with the designated target. In a fourth aspect, a laser rangefinder, comprises: a laser designator capable of designating a target from an estimated target state; and a quad cell detector capable of receiving the designation.

16 Claims, 5 Drawing Sheets

CONTINUOUS ALIGNMENT SYSTEM FOR FIRE CONTROL

This is a continuation of U.S. application Ser. No. 11/675,419 ("the '419 application"), entitled "Continuous Alignment System for Fire Control", filed Feb. 15, 2007 now abandoned, in the name of the inventors Michael R. Willingham and Robert J. McCarty, Jr. The '419 application claimed the earlier effective filing date of U.S. Provisional Application Ser. No. 60/773,531 ("the '531 application"), entitled "CONTINUOUS ALIGNMENT SYSTEM FOR FIRE CONTROL" filed Feb. 15, 2006, in the name of the inventors Michael R. Willingham and Robert J. McCarty, Jr. The earlier effective filing dates of the '419 and '531 applications are hereby claimed for all common subject matter. The '419 and '531 applications are also hereby incorporated by reference in its entirety for all purposes as if expressly set forth verbatim herein.

The U.S. Government has a paid-up license in this invention and the right in limited circumstances to require the patent owner to license others on reasonable terms as provided for by the terms of contract 3G19ADFJ-1D01 awarded by the Department of Defense.

BACKGROUND OF THE INVENTION

1. Field of the Invention

The present invention pertains to fire control systems, and, more particularly, to alignment of fire control systems.

2. Description of the Related Art

In a fundamental sense, "fire control" refers to the ability to control a weapon system so that one accurately hits a target at which one is firing—typically, with a projectile of some sort. A simple fire control for a simple system—e.g., shooting a firearm—may include merely sighting along the boresight of the weapon. Fire control systems have evolved much higher complexity along with the weapon systems with which they are associated. Consider, for instance, the Aegis combat system found aboard the Ticonderoga-class guided missile cruisers of the United States Navy. The Aegis combat system, according to some sources, is capable of simultaneous anti-air, anti-surface and anti-submarine warfare, including search, tracking, and missile guidance functions simultaneously with a track capacity of over 200 targets at more than 200 miles. In large part, this increase in complexity has arisen from increased automation permitted by rapid growth in powerful computing technology.

Increased complexity typically affords increased opportunity for error. Two kinds of error are "target location error" and "alignment error." Target location errors are differences between where the weapon system thinks the target is and where it actually is according to an absolute reference. These can arise from such various sources incorrectly reckoning the position to which a moving target will move, errors in data entry, and differences in reference systems between different sources of positioning information. Alignment errors are differences between where the weapon is line of fire actually is and where the line of fire should be.

In a Future Combat Systems ("FCS") program sponsored by the United States military, an Armed Robotic Vehicle-Assault (Light) ("ARV-A(L)") vehicle is under development. Weight reduction efforts and integration complexities have forced separation of the gun targeting system from the gun turret so that the gun and targeting system experience a different set of alignment errors. The ARV-A(L) vehicle features the Medium Range Electro Optic Infrared ("MR EO/IR") targeting sensor system with its internal gimbal mounted directly to a fixed kingpost. The ARV-A (L) also incorporates an XM-307 gun on a separate azimuth rotational system that revolves around the fixed kingpost. In the current design, target states are estimated from MR EO/IR data and fire control uses the MR EO/IR target tracks to develop a fire control solution. Unknown alignment errors between the MR EO/IR sensor and the gun coordinate systems could cause errors in target position and velocity when referenced to the gun coordinate system during firing.

Traditional gun systems have utilized a bore sighting methodology to accurately align the gun and missile systems with the sensor. Bore sighting can be a slow and often repeated process, dependant upon the ability of the system to remain in alignment between bore sighting events. The ARV-A (L), as a 2½ ton to 3 ton class system, will not have the massive and rigid structure traditionally associated with combat vehicles, which will make retention of bore sight alignment much more difficult. Effects of shock and vibration, solar heating, reduced vehicle stiffness through use of light weight materials, and the need to constantly travel over rough terrain will increase the need for bore sighting. On an unmanned vehicle, this is very undesirable, as traditional bore sighting requires at least one man to be involved. A kingpost design further complicates alignment of the sensor to the weapon systems, as two distinct points of azimuth and elevation rotation will exist-one for the sensor, and one for the weapons.

Transfer alignment can be automated and used to align the two azimuth rotation points through the use of inclinometers. The inclinometers could be placed on the sensor and weapons deck base and measurements taken at all 360° of rotation for each of the two rotation points. Differences in angle could be removed via algorithms in the fire control system. This process would eliminate most alignment error between the two azimuth planes, but would not be a complete solution.

The present invention is directed to resolving, or at least reducing, one or all of the problems mentioned above.

SUMMARY OF THE INVENTION

In a first aspect, an automated method for engaging a target comprises: slewing a weapon to an estimated target state; and aligning the weapon's boresight with the actual target state. Aligning the weapon's boresight with the actual target state includes designating the target to obtain the actual target state; and zeroing an offset between the actual target state and the estimated target state.

In a second aspect, an apparatus comprises: means for slewing a weapon to an estimated target state; and means aligning the weapon's boresight with the actual target state. The aligning means includes designating the target to obtain the actual target state; and zeroing an offset between the actual target state and the estimated target state.

In a third aspect, a weapon system comprises: a targeting sensor capable of designating a target; a weapon; and an alignment sensor associated with the weapon, and capable of receiving the designation and aligning the weapon's boresight with the designated target.

In a fourth aspect, a laser rangefinder, comprises: a laser designator capable of designating a target; and a quad cell detector capable of receiving the designation.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
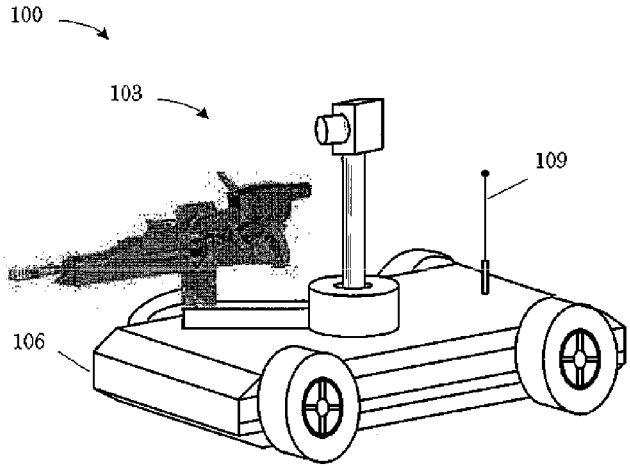
FIG. 1 is a perspective view of a vehicle including a weapon system constructed and operated in accordance with the present invention.

FIG. 1 is a perspective view of an apparatus 100 including a weapon system 103 constructed and operated in accordance with the present invention. The weapon system 103 is mounted to a vehicle 106. In the illustrated embodiment, the vehicle 106 is robotic or autonomous, i.e., there is no human operator on board the vehicle 106. However, this is not required for the practice of the invention. Alternative embodiments may be remotely operated or manned. Similarly, the weapon system 103 may be mounted to vehicles that are airborne or marine-based. The weapon system 103 may even be mounted to platforms that are not vehicles in some alternative embodiments. However, vehicles are more likely to benefit from the active alignment that the illustrated embodiment of the present invention provides because of structural integrity and rigidity issues.

The vehicle 106 is, more particularly, an ARV-A(L) vehicle in the illustrated embodiment. The ARV vehicle has semi-autonomous navigation and mission equipment operations, with man-in-the-loop weapon fire authorization via a command, control, communications, computers, intelligence, surveillance, and reconnaissance subsystems ("C4ISR") network (not shown) such as is known in the art. The ARV-A(L) will be remotely controlled by operators in the field, or perhaps at a rear echelon location.

Figure 2:
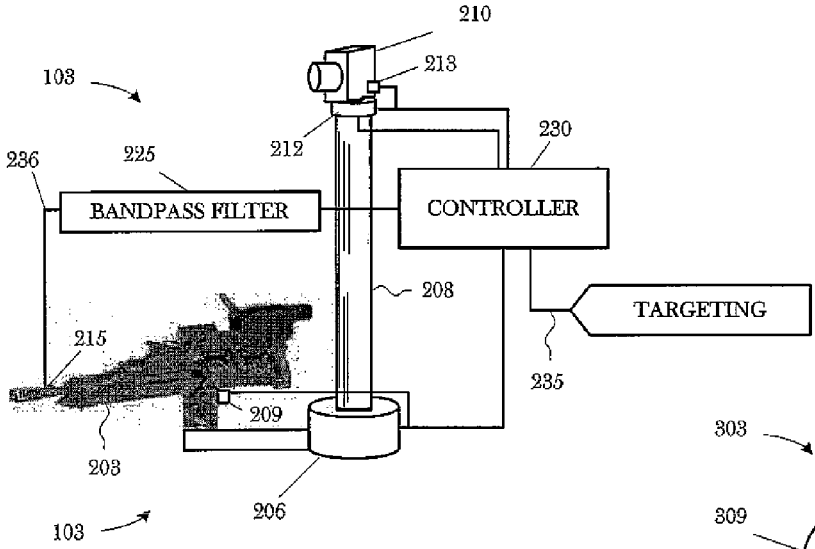
FIG. 2 conceptually illustrates the weapon system in FIG. 1.

FIG. 2 conceptually illustrates the weapon system 103 of FIG. 1. The weapon system 103 includes a weapon 200. The weapon 200 is, in the illustrated embodiment, built around a gun 203 driven in azimuth by a motor 206 and in elevation by a motor 209. The weapon 200 is a XM307 gun system, such that the gun 203 is a 25 mm airbursting gun. More particularly, the weapon 200 is a Remotely Operated Variant ("ROV") of the XM307 gun system. The XM307 is currently being developed by General Dynamics Armament and Technical Products ("GDATP"). It is nominally a grenade machine gun firing 25 mm airbursting ammunition. The XM307 is lightweight and portable with more efficient recoil management relative to current heavy and grenade machine guns.

Selected information regarding the XM307 is set forth in Table 1 below.

TABLE 1

| Selected Information on XM307 Gun System | |
|---|---|
| System | |
| Weight | 50 Pounds (19.05 kg) (Gun, Mount, and Fire Control) |
| Fire Control | Full Solution, Day/Night |
| Portability | Two-Man Portable & Vehicle Mountable |
| Stability | Up to 18" Tripod Height |
| Environmental | Operationally Insensitive to Conditions |
| Gun | |
| Dimensions | 9.9" W × 7.2" H × 52.3" L max (43.3" L charged)/ 251.46 × 182.88 × 1328.42 mm (1099.82 charged) |
| Rate of Fire | 250 Shots per Minute, Automatic |
| Dispersion | Less than 1.5 Mils, One Sigma Radius |
| Range | Lethal and Suppressive Out to 2,000 Meters |
| Ammunition | High-Explosive Airbursting, Armor Piercing, and Training Ammunition (HE, AP, TP, TP-S) |
| Feed System | Weapon-Mountable Ammunition Can (Left Feed) |

(Source: http://www.gdatp.com/products/lethality/xm307/xm307.htm) The XM307 can be also converted to a 12.7 mm machine gun. Additional information regarding the XM307 is widely available from numerous public sources, including a number of sources on the World Wide Web of the Internet or may be obtained from General Dynamics, Armament and Technical Products, Four LakePointe Plaza, 2118 Water Ridge Parkway, Charlotte, N.C. 28217, http://www.gdatp.com. Note, however, that the present invention is not limited to this weapon system and any suitable weapon system known to the art may be employed.

The XM307 is integrated into a vehicle-mounted firing station (not otherwise shown) that is remotely controlled by the operator (not shown). As will be discussed further below, remote sensing systems, such as cameras and range finders, in the firing station allow the operator to accurately and remotely identify and engage targets in a manner known in the art. These remote systems are housed in the targeting sensor 210. The weapon 203 can achieve −15° to +60° or lesser elevation coverage. The weapon system 103 provides the near field protection for the vehicle. It engages targets very near the vehicle, and fires at down angles up to 15° from prepared defensive positions as well as targets in tall structures.

As alluded to above, the targeting sensor 210 includes a number of capabilities. Foremost among these capabilities in the illustrated embodiments is a laser range finding capability. The targeting sensor 210 is gimbaled using techniques well known to the art. More particularly, in the illustrated embodiment, the targeting sensor 210 is a MR EO/IR targeting sensor system developed by Raytheon. Note that this sensor is but one sensor that may be used in implementing the present invention. Its use is not necessary to the practice of the invention and that other suitable sensors may be used instead. The MR EO/IR is a forward looking infra-red ("FLIR") sensor supplemented with visible cameras and a laser rangefinder. The targeting sensor 210 is gimbaled, with its internal gimbal (not shown) mounted directly to a fixed kingpost 208. The targeting sensor 210 is driven in azimuth by the motor 212 and in elevation by the motor 213.

The motors 206, 209 and 212, 213 may be implemented in any of a number of ways. For instance, various embodiments might employ conventional motors/gearbox arrangements for elevation/azimuth rotation; direct drive motors/brake for elevation and azimuth rotation; or direct drive or conventional azimuth, with ball screw actuators for elevation rotation. Direct drive motors and ball screw actuators offer minimal backlash designs for optimizing motion control and pointing accuracy, but tend to be large and heavy, especially when compared to traditional motors and integrated gearboxes. The azimuth drive and elevation drives for the gun system will be highly accurate. Thus, the conventional, lightweight motors/gearbox approach is used in the illustrated embodiment. But backlash from the gearbox may be too high for some embodiments such that direct drive and ball screw options might be used instead.

Still referring to FIG. 2, the weapon system 103 also includes an alignment sensor 215. The specifications for the alignment sensor 215 of the illustrated embodiment are listed in Table 2. In the illustrated embodiment, the targeting sensor 210 is mounted on a post and the weapon 203 is mounted below it on a coaxial mount so that the weapon 203 revolves around the post mount without the targeting sensor 210 moving at all. The alignment sensor 215 is "co-mounted" with the weapon 203. "Co-mounting" refers to the alignment sensor 215 being mounted on the weapon 203 or on the mount to the weapon 203, i.e., the alignment sensor 215 moves in tandem with the weapon 203. In the illustrated embodiment, the alignment sensor 215 is co-mounted with weapon 203 on the barrel or on the base to which the weapon 203 is mounted.

TABLE 2

| Alignment Sensor Requirements | |
|---|---|
| Noise Equivalent Angle | 100 μrad (1 sigma) |
| Maximum Range | 1500 meters at 3 NMi visibility |
| Operating temperature | −40 to 85 degrees C. |
| Package size | Notionally 15" by 3" diameter |
| Target reflectivity | 0.2 lambertian |

Additional factors that may be considered in some embodiments include shock environment, non-operational temperature, and vibration. Other considerations affecting pointing that are independent of the alignment sensor 215 and that may impact implementation are set forth in Table 3.

TABLE 3

| Other Considerations Affecting Pointing | |
|---|---|
| Atmospheric jitter | 50 urad (1 sigma, worse case at 1500 m) |
| Laser Range Finder Jitter | 100 urad (1 sigma) |

The implementation of the alignment sensor 215 in the illustrated embodiment focused on simplicity and compact size. A secondary consideration is that it have a path to increased sensitivity should that be desirable at some point in the future.

Figure 3A:
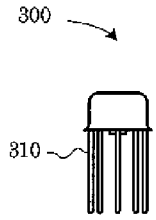
FIG. 3A-FIG. 3B are plan side and plan top views of the detector of the alignment sensor of FIG. 2.
Figure 3B:
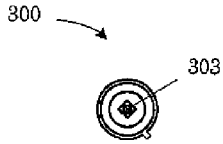
Figure 4:
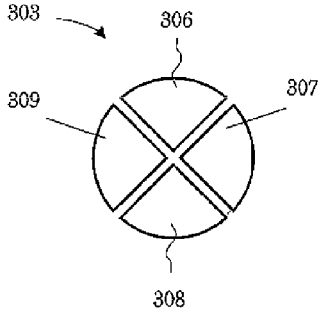
FIG. 4 is a plan top view of the active area of the alignment sensor first shown in FIG. 3A-FIG. 3B.

To address these factors, alignment sensor 215 if the illustrated embodiment is implemented in a quad-type detector 300, shown in FIG. 3A-FIG. 3B, for the alignment function. The detector is an Indium-Gallium-Arsenide (InGaAs) type photodiode. As is best shown in FIG. 4, the active surface 303 of the detector 300 comprises four cells 306-309. Note that the number of cells in the active surface is not material to the practice of the invention. Other numbers of cells may be used in alternative embodiments, although a number equal to and exceeding three yield better results.

However, the invention is not limited to the type of detector represented by the quad-cell detector 300. The basic concept could be implemented with other devices, such as a charge-coupled device ("CCD") self scanned array could be used to accomplish the basic alignment. Basically any detector that provides X-Y coordinate output could be used. If alignment is only needed in one axis, a linear array could be used. Also, the basic concept can be implemented in full analog, full digital, and a hybrid of the two (part digital, part analog). One particular implementation is a hybrid with an analog detector output that is digitized and processed digitally.

Detectors of this type are found to be available in 1 mm, 2 mm, and 3 mm diameters, with the 1 mm diameter having the correct electrical parameter for this application (high bandwidth for the laser pulse). The lens chosen for this detector is a 5 cm focal length, 2.54 cm diameter lens. The focal length chosen provides a 20 milliradian full width field of view and the aperture provides adequate sensitivity. In particular, the aperture should be wide enough to provide a field of view wide enough to be able to see the laser designation and encompass the errors associated with that task, but not so wide that it detects so much noise that one cannot pick out spot. This type of tradeoff is common in the art, and those skilled in the art having the benefit of this disclosure will readily be able to implement this aspect of the present invention.

Additional sensitivity can be obtained through minor modifications. For example, by increasing the size of the aperture to 5 cm the signal-to-noise ratio ("SNR") can be improved by a factor of 4 which will allow operation in more degraded atmospheric (approximately 2 nautical miles) visibility at a modest increase in package size while still maintaining an angular accuracy of 0.095 milliradians. An increase in field of view to ensure the initial laser pulse falls on the detector can be obtained by using a shorter focal length lens, or if a reduced electrical bandwidth can be tolerated, a larger detector may instead be used.

Suitable quad detectors of the type disclosed are commercially available off the shelf. One such suitable detector is the Hamamatsu G6849-1 Imaging Sensor/Array InGaAs PIN photodiode. (See http://sales.hamamatsu.com/en/pro ducts/solid-state-division/ingaas-pin-photodiodes/image-sensor-array/productlist.php?&overview=13157900) Such detectors are available from Hamamatsu Photonics, K.K., headquartered in Hamamatsu City, Japan, through their sales representatives at 360 Foothill Rd, Bridgewater, N.J. 08807; Telephone: 908-231-0960; 908-231-1218. Additional information may be found on the World Wide Web of the Internet at <http://sales.hamamatsu.com/en/home.php>.

Note that multi-cell detectors such as the detector 300 are not necessary to the practice of the invention. The alignment sensor 215 may be implemented using other technologies in alternative embodiments. For example, a staring array, sometimes also called a charge-coupled device ("CCD") imager or a focal plane array ("FPA"), could be used, but it becomes more difficult due to the short duration of the laser pulses that will be discussed further below. Still other technologies might find application, as well.

The illustrated embodiment also employs an optical bandpass filter 225. The bandpass filter 225 minimizes background noise on the detector 300, shown in FIG. 3A-FIG. 3B, in the return signal. A 10 nm bandpass filter was chosen as it is commonly available and reduces the optical noise to levels consistent with the dark current output of the detector. Note that the filter 225 is optional, and may be omitted in some embodiments. Again, this is a tradeoff between spot intensity and noise. However, because the frequency of interest is derived from the spot, and therefore known, the bandpass filter 225 is a convenient mechanism for separating the spot from the noise.

Figure 5:
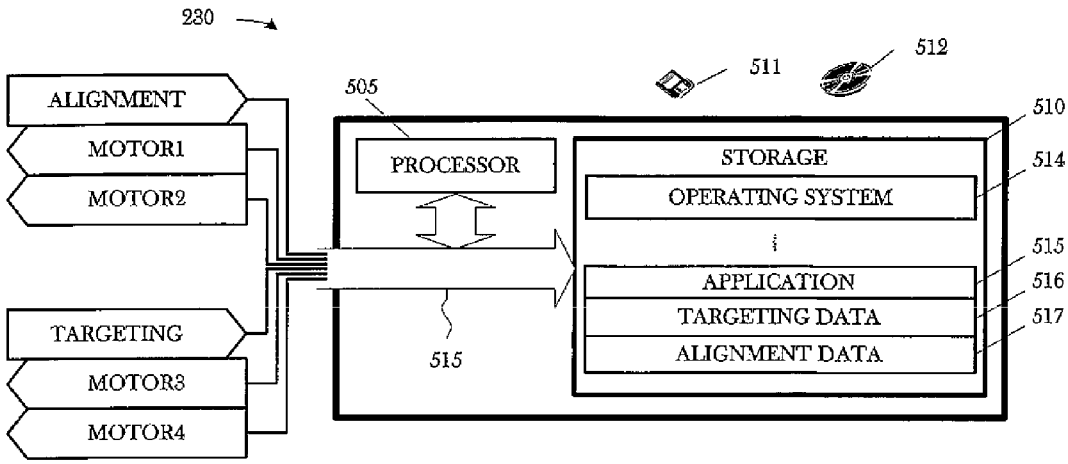
FIG. 5 conceptually illustrates selected aspects of the hardware and software architectures of the controller of the weapon system in FIG. 2.

Finally, the weapon system 103 includes a controller 230. FIG. 5 conceptually illustrates the controller 230 of the weapon system 103 in FIG. 2. The controller 230 comprises a processor 505 communicating with a storage 510 over a bus system 515. The bus system 515 may operate in accordance with any suitable bus protocol—whether standard or proprietary—known to the art. The storage 510 may have any suitable structure known to the art and may include a hard disk and/or random access memory ("RAM") and/or removable storage such as a magnetic disk 511 and an optical disk 512.

The processor 505 may be implemented using any suitable processor known to the art. Some types of processors may be more preferable than others for given embodiments. For instance, a 64-bit processor is generally more powerful than an 8-bit processor, but will consume more power, and one may be more suitable than the other depending on power and processing requirements. Similarly, a digital signal processor ("DSP") may be preferred over a general purpose processor in some embodiments with intensive signal processing. Some embodiments may even implement the processor 505 as a processor set, e.g., a microprocessor and a math co-processor. The implementation of the processor 505 will therefore be responsive to design constraints of a given embodiment.

The storage 510 is encoded with an operating system 514, an application 515, a data structure comprising targeting data 516, and a data structure comprising alignment data 517. The processor 505 operates under the programmed control of the application 515 within the context of the operating system 514. The operating system 514 may be any suitable operating system known to the art—e.g., UNIX or DOS. Similarly, the application 515 may be coded in any suitable program language known to the art. The data structures in which the targeting data 516 and alignment data 517 are stored may be any suitable type of data structure, such as a list, a linked list, a database, a stack, or a first-in, first-out ("FIFO") queue.

Referring now to both FIG. 2 and FIG. 5, the controller 230 receives the targeting data 516 and the alignment data 517 over the lines 235, 236, respectively. The targeting data 516 is received from off-board in a manner discussed further below. The alignment data 517 is received from the detector 300, shown in FIG. 3A-FIG. 3B, of the alignment sensor 210. The processor 505 buffers, or otherwise stores, the targeting data 516 and the alignment data 517 in the respective data structures as described above. Responsive to that data, and in accordance with selected aspects of the present invention, the processor 505, under the control of the application 516, then issues command and control signals MOTOR1-MOTOR4 to the servo-motors 212-213, 206, 209 to control the pointing of the targeting sensor 210 and weapon 203.

The application 515, shown in FIG. 5, at least portions of the method of the invention. Some portions of the detailed descriptions herein are consequently presented in terms of a software implemented process involving symbolic representations of operations on data bits within a memory in a computing system or a computing device. These descriptions and representations are the means used by those in the art to most effectively convey the substance of their work to others skilled in the art. The process and operation require physical manipulations of physical quantities. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated or otherwise as may be apparent, throughout the present disclosure, these descriptions refer to the action and processes of an electronic device, that manipulates and transforms data represented as physical (electronic, magnetic, or optical) quantities within some electronic device's storage into other data similarly represented as physical quantities within the storage, or in transmission or display devices. Exemplary of the terms denoting such a description are, without limitation, the terms "processing," "computing," "calculating," "determining," "displaying," and the like.

Note also that the software implemented aspects of the invention are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The invention is not limited by these aspects of any given implementation.

Figure 6:
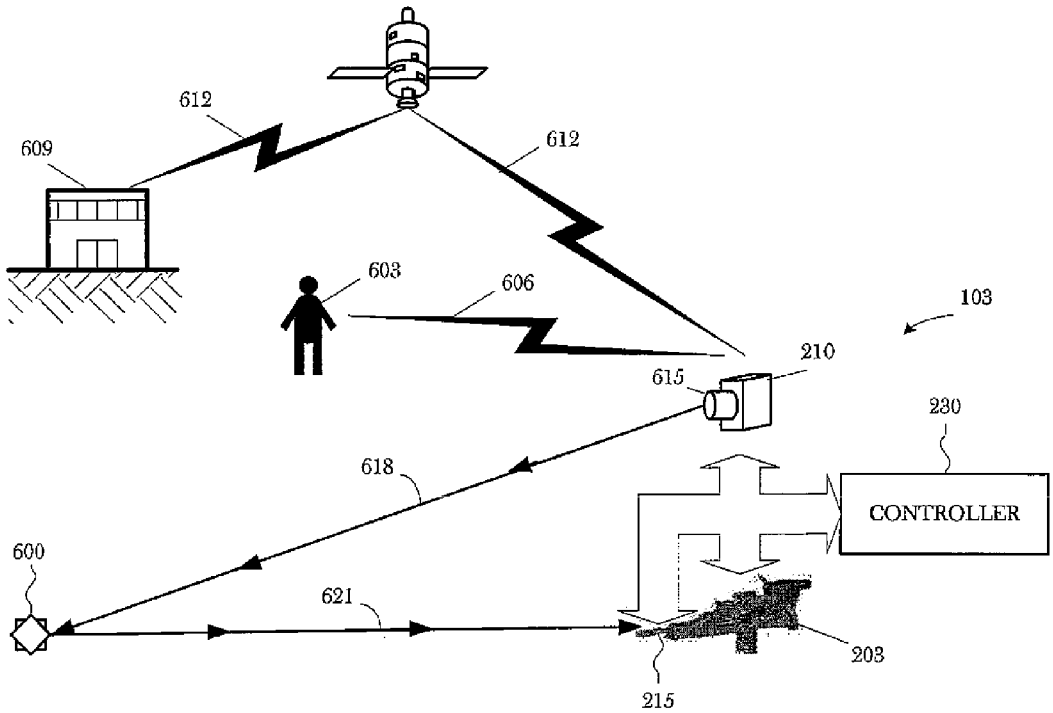
FIG. 6 conceptually illustrates the operation of the weapon system of FIG. 2 in one particular embodiment.

Turning now to FIG. 6, in operation, the weapon system 103 receives an initial estimate of the position for the target 600 from off-board. The initial estimate may be received, for instance, directly from an operator 603 over a communications link 606, which may be wireless. Or, the initial estimate may be received from a command center 609 over satellite links 612. Or, in some embodiments, the initial estimate may be received by some combination of these. Other techniques may be employed. For example, an operator 603 may enter target coordinates through a user interface (not shown) including a keypad.

The "initial estimate" is treated as "initial" because it likely contains a target location error. As those in the art having the benefit of this disclosure will appreciate, it is entirely possible that the initial estimate may be accurate, i.e., without target location error. All such targeting data received from off-board is nevertheless treated as an "initial estimate." Also, in some embodiments, the target state can be expected to change over time. In these embodiments, the target state is tracked and projected such that estimated target position is updated over time. One such embodiment is discussed further below.

Figure 7:
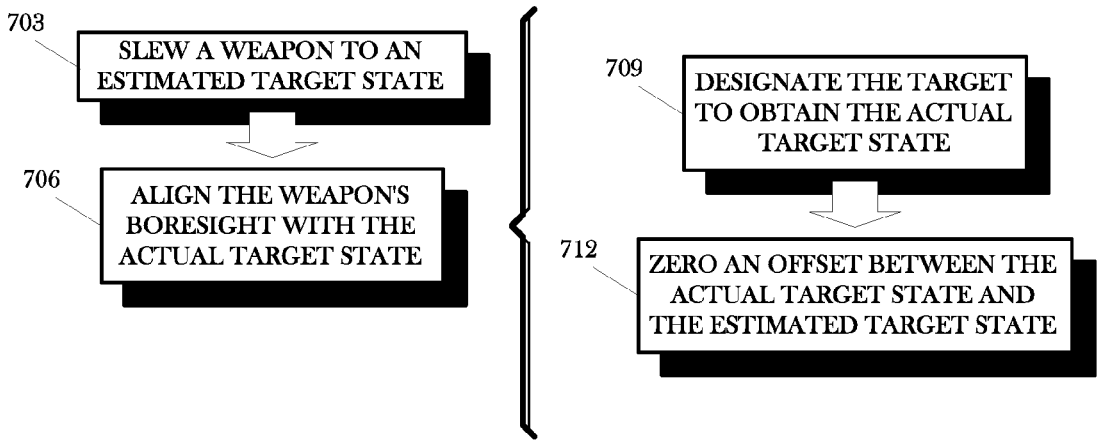
FIG. 7 is a flow chart of the operation illustrated in FIG. 6.

The controller 230 stores the initial estimate as the targeting data 516, shown in FIG. 5. The processor 505, under the programmed control of the application 516, then issues commands to the motors 206, 209 to begin pointing the weapon 203 to the initial estimate of the target position. Thus, as is shown in FIG. 7, the weapon system 103 begins automatically slewing (at 703) the weapon 203 to an estimated target state. The controller 230 then automatically aligns (at 706) the weapon's boresight with the actual target state, i.e., the actual position of the target 600. In the illustrated embodiment, this involves designating (at 709) the target 600 to obtain the actual target state; and zeroing (at 712) an offset between the actual target state and the estimated target state.

More precisely, in the illustrated embodiment, the targeting sensor 210 includes a laser designator 615. The controller 230 points the laser designator 615 at the estimated target position. The laser designator 615 then fires a pulsed laser signal 618 at the target 600 to "spot" the target 600. The laser signal 618 is then reflected, and the alignment sensor 215 detects the reflection 621. Note that this means that the initial estimate puts the target 600 within the field of view for the alignment sensor 215. The field of view is a function of the detector employed by the alignment sensor 215, and so the detector's implementation can significantly impact the overall performance of the weapon system 103.

Figure 8A:
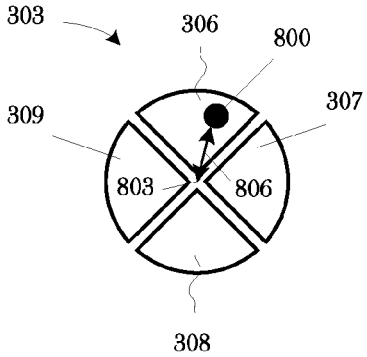
FIG. 8A-FIG. 8B depict the detection of the laser signal in FIG. 6 by the impingement of the reflection on the active surface of the detector of the illustrated embodiment.
Figure 8B:
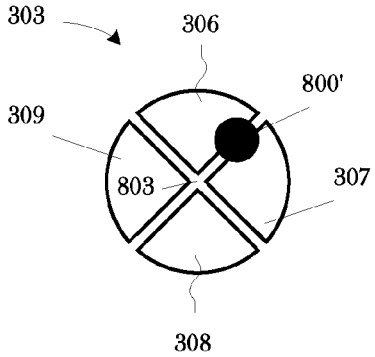

As noted above, the alignment sensor 215 employs, in this particular embodiment, a quad cell detector such as the detector 300 in FIG. 3A-FIG. 3B. The reflection 621 impinges upon the active surface 303, as is best shown in FIG. 8A as a spot 800. As those in the art having the benefit of this disclosure will appreciate, the size of the spot 800 will depend on a number of factors such as the beam width of the laser signal 618 and the distance traveled. Furthermore, although the spot 800 is shown in a single quadrant—i.e., the quadrant 306, it may frequently impinge in more than one such quadrant. For instance, in FIG. 8B, the spot 800' is shown a bit larger and impinging in two quadrants, i.e., the quadrants 806, 807.

The center 803 of the active surface 303 represents a correct alignment between the weapon 203 and the targeting sensor 210. Thus, the position of the spot 800 in FIG. 8A is offset 806 both in azimuth and in elevation from the center 803 to indicate a misalignment between the weapon's boresight and the actual target state, or location. The detector 300 generates electrical signals over the pins 310 (only one indicated), shown in FIG. 3A, indicative of what quadrants the spot 800 is impinging upon and with what intensity. This ALIGNMENT data is transmitted to the controller 230 whereupon the application 515, shown in FIG. 5, determines the offset 806 and issues commands to the servo-motors 206, 209, 212, 213, shown in FIG. 2, to eliminate the offset 806. If the platform and the target 600 are moving relative to one another, this may take a series of commands. Eventually, the boresight of the weapon 203 zeroes in on the target 600 as the offset 806 is eliminated.

Various embodiments may determine the commands to eliminate the offset 806 in different ways. For instance, corrections to the angles in azimuth and elevation can be calculated directly from the offset 806. Alternatively, the angle corrections can be stored in a look up table (not shown) indexed by the ALIGNMENT data. Other approaches may be appreciated by those skilled in the art having the benefit of this disclosure. Any suitable technique may be employed.

Thus, in the illustrated embodiment, a boresighting sensor (i.e., the four quadrant detector) is affixed to the weapon that "finds" the MR EO/IR laser rangefinder spot on the target and allows misalignment to be corrected prior to firing the weapon. The quad cell detector is mounted co-boresighted to the gun in the same way a conventional gun sight is mounted. The quad cell is used to detect and track the laser range finder ("LRF") spot during a target engagement and gives a measurement of azimuth and elevation error from gun boresight. The target range measurement from the MR EO/IR is mixed synchronously with angles from the quad cell to give an unambiguous target position measurement. The target position measurement is converted to local vertical North-East-Down ("NED") coordinates and used to estimate target states using a Kalman filter.

Figure 9:
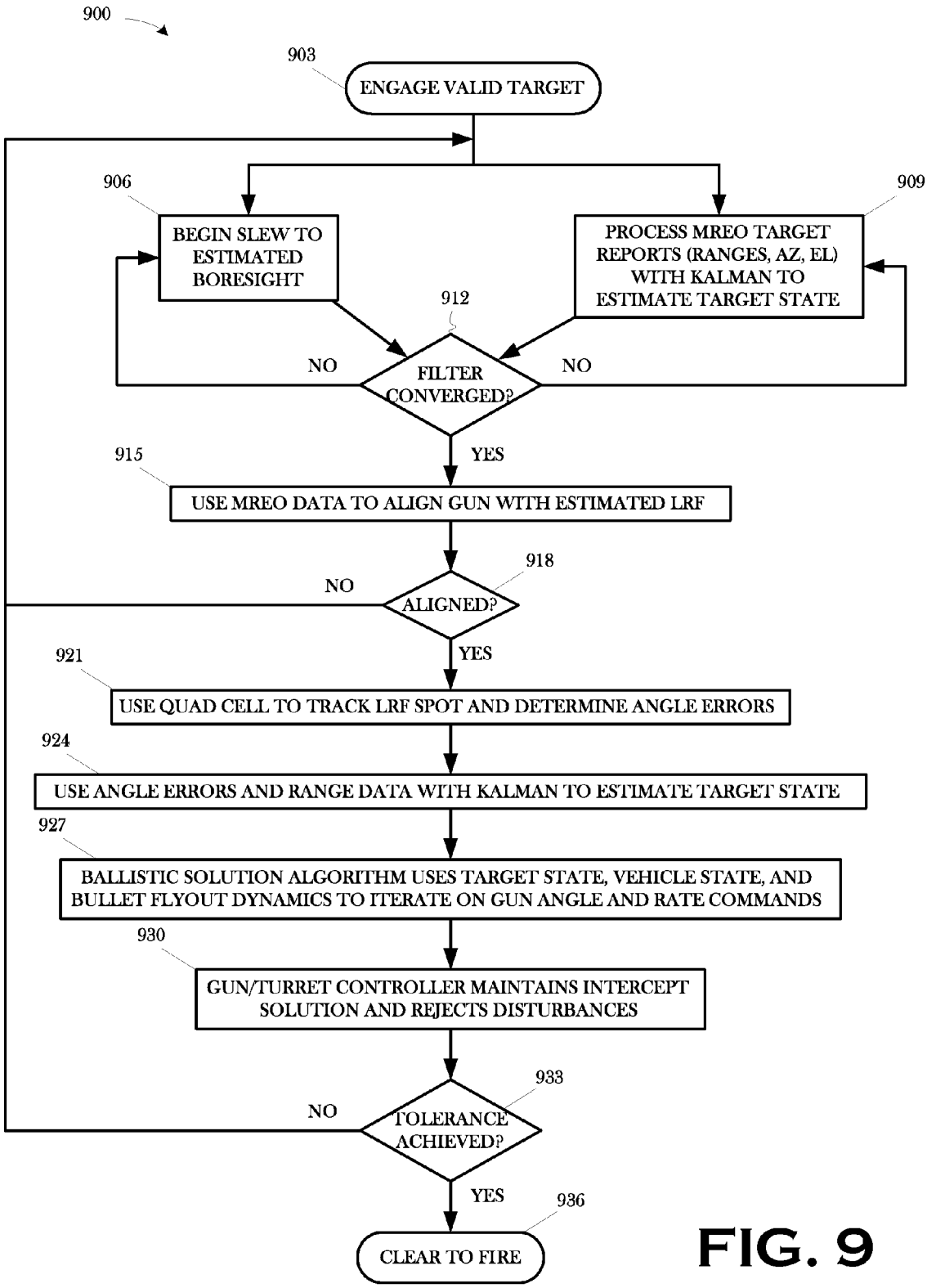
FIG. 9 charts the sequence of events in the engagement of an enemy in one particular embodiment of the present invention.

The sequence of events 900 for a target engagement is shown in FIG. 9, which assumes relative movement between the weapon system and the target. The sequence 900 begins with the engagement (at 903) of a valid target. The gun begins slewing (at 906) to the estimated boresight while MREO data is processed (at 909) to yield new estimates. When the filter converges (at 912), the MREO data is used to align the gun with the estimated laser range finder ("LRF") (at 915). Once they are aligned (at 918), the quad cell is used (at 921) to track the LRF spot and determine angle errors. The angle errors and range data with the Kalman are then used (at 924) to estimate the target state. The ballistic solution algorithm is then called (at 927) to iterate on gun angels and rate commands. The gun/turret controller (not shown) maintain (at 930) the intercept solution and rejects disturbances. When tolerance is achieved (at 933), the clear to fire command can be given (at 936).

Thus, instead of using target state information directly from the MR EO/IR sensor, the quad cell/gun is commanded to align along the line-of-sight to the target as estimated from MR EO/IR data. The quad cell then acquires the target and measurements of angles from the quad cell are used to make a second set of target state estimates. Alignment of the quad cell to the target is performed during target state development since the quad cell has a very narrow field-of-view (20 mrad full angle). After the Kalman filter using the quad cell data converges, a ballistic flyout algorithm is called and when the ballistic algorithm converges to a bullet-target intercept the gun super elevates, leads (if the target is moving) and fires. To give a good ballistic-target intercept solution, the quad cell detector and optics are accurately aligned to the gun (~100 urad), and measurement jitter is sought to be mitigated.

Immediately prior to firing the weapon on a target, the range to target is determined through use of the MR EO/IR laser rangefinder by firing several laser pulses. The first pulse that results in a valid range falls somewhere on the alignment sensor 215's detector 300, resulting in an error signal. Refinement to the weapon pointing is then accomplished and subsequent laser pulses fall very near the center of the quad detector and are averaged for improved angular resolution, providing validation of the gun and sensor alignment. Simultaneously, the laser spot is imaged by the MR EO/IR short wave infrared ("SWIR") sensor to ensure it is centered on the target, validating the laser pointing.

Once alignment is determined, the gun can be correctly pointed (lead if necessary and super elevation) to ensure that the bullets hit the target. This process depends on there being a degree of alignment that is maintained between the quad cell/gun to the MR EO/IR to accuracy of 8 milliradians or better. This degree of alignment should be maintainable through mechanical tolerances.

"Clear to fire" comes from a human operator.

Thus, mounting the quad cell detector on the gun (on the rail at the rear of the gun) makes physical bore sighting automatic and transparent to the user process performed in conjunction with rangefinding immediately prior to firing on a target, and provides additional safety measures for firing weapons from an unmanned vehicle. In an engagement, the MR EO/IR sensor would identify a potential target using visual cues, and bring the gun system in line to the target by rotating the weapons deck azimuth and gun elevation system. When MR EO/IR sensor lazes a target to get the range, the quad sensor would sense the illuminated spot within its field of view and determine any misalignment (the spot would be off center in the quad sensor field of view if misaligned) with the sensor. This misalignment would be automatically removed through the use of algorithms/Kalman filters before the gun system moves to lead the target (for moving targets) and super elevates to account for range to target. In a sense, the system would bore sight the alignment of the gun to the sensor prior to each time the gun fires.

A computer simulation was run to determine the sensitivity of the alignment sensor 215 of the above design to detect pulses in the environment given. The simulation established that the sensitivity is limited by the detector pre-amp noise, although it is sufficiently sensitive for detecting pulses in severe visibility conditions, specifically a 3 nautical miles visibility. However, the position sensing sensitivity is rather more dependent on SNR and is limited to 0.095 milliradians, more than the jitter expected due to atmospheric scintillation, but still meeting the sensor angular accuracy requirement of 0.1 milliradians.

The illustrated embodiment disclosed above employs a laser rangefinder, but alternative embodiments may use other kinds of radiation. For instance, embodiments employing the quad detector 300 of FIG. 3A-FIG. 3B and that image the return can employ any radiation that can be imaged onto some type of four-quadrant detector. So, radio frequency ("RF"), infrared ("IR"), Near IR ("NIR"), Visible, ultraviolet ("UV"), X-ray, gamma, beta, alpha, and possibly other parts of the electromagnetic spectrum could be used in such embodiments. However, for any radiation, there should be the capability to coherently detect to determine the origin of the radiation.

One advantage of the laser rangefinder is that it yields three-dimensional ("3D") data, i.e., azimuth, elevation, and range. The offset between the estimated target state and the actual target state may therefore also include offset in range in some embodiments. However, this is an implementation specific detail for this particular embodiment. One significant use for the present invention is azimuth and elevation error correction, which can be performed with two-dimensional ("2D") data, and some embodiments may employ 2D data to the exclusion of 3D data. The 3D data additionally helps the fire solution and resolves some safety issues, but is not necessary in all embodiments.

The illustrated embodiment is also what may be called an "active" system in that the detected radiation is generated and transmitted from the same system of which the detector is a part. However, in some embodiments, the invention may be "semi-active", e.g., the radiation may originate from a third party laser designator remote from the detector. However, for very short duration pulses, it may be necessary to have some information about the timing of the pulse in order to detect it above the background noise level. If there is a common communication path to coordinate time or both parties have access to a time base such as GPS, then a pulsed laser could be used. This information could be sent automatically over a network referring to a common Global Positioning System ("GPS")-based timebase. The time of the origination would be known to both parties and each could measure the pulse receipt. With that and certain other coordinate knowledge in common, a correction could be computed to rationalize the two coordinate systems to each other. Some alternative embodiments may even be totally "passive," e.g., the detected radiation is not introduced into the environment for purposes of detection, if there is some way to correlate that both systems are imaging the same target or point on a target.

Figure 10:
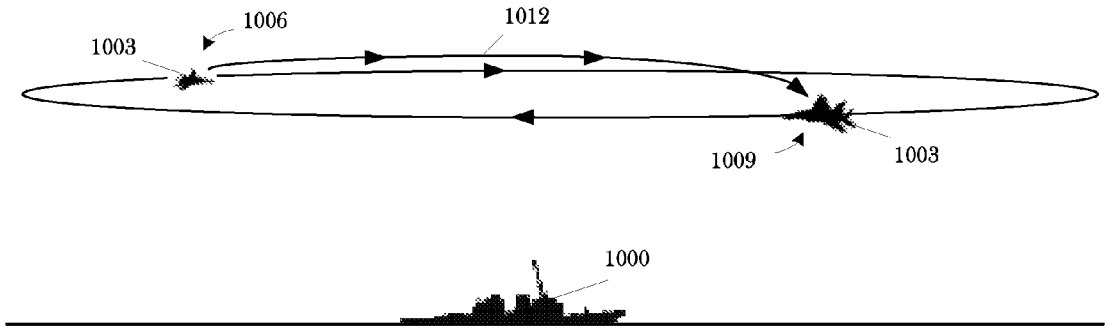
FIG. 10 illustrates two scenarios in which multiple weapons might be controlled in accordance with the present invention.

The invention may also be extrapolated to alternative fire control system architectures. Consider, for instance, FIG. 10, which portrays a warship 1000 and an aircraft 1003. The aircraft 1003 is shown in a first position 1006 and in a second position 1009. In one scenario, the aircraft 1003 flies from the first position, port and aft of the warship 1000, across the warship 1000 as indicated by the arrow 1012 to the second position 1009, starboard and forward of the warship 1000. The warship 1000 may wish to engage the aircraft 1003, but may wish to do so with a different weapon depending on whether the aircraft 1003 is in the first or second positions 1006, 1009. In a second scenario, the aircraft 1003 circles the warship 1000 as indicated by the arrow 1015, targeting the warship 1000 with multiple weapons.

Figure 11A:
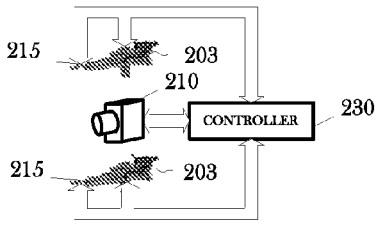
FIG. 11A-FIG. 11D depict several alternative fire control architectures in accordance with various embodiments of the present invention.
Figure 11B:
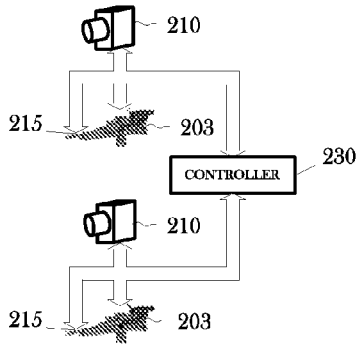
Figure 11C:
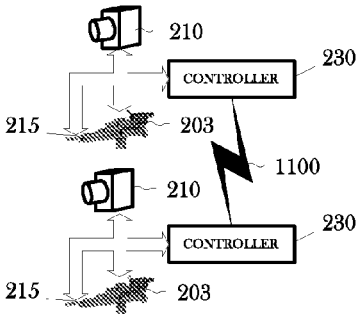
Figure 11D:
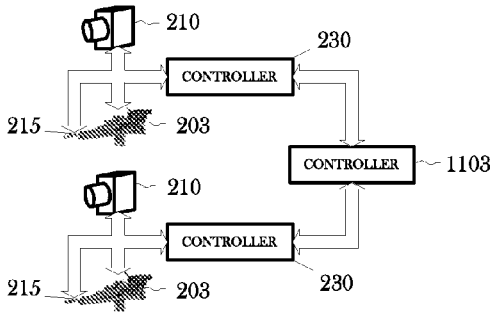

These kinds of scenarios may be referred to as "cooperative firing contexts" because of the level of cooperation among the parts of the weapons system. In either of these scenarios, the fire control technique described above can be extrapolated across multiple weapons in a variety of ways. FIG. 11A-FIG. 11D depicts a number of alternative embodiments in which:

- in FIG. 11A, depicts an architecture in which multiple weapons 203 are aligned to a single targeting sensor 210, each using a respective alignment sensor 215, by a single controller 230;
- in FIG. 11B, multiple weapons 203, each equipped with a respective alignment sensor 215, are aligned to a respective targeting sensor 210 by a common controller 230;
- in FIG. 11C, multiple weapons 203, each equipped with a respective alignment sensor 215, are aligned to a respective targeting sensor 210 by a respective controller 230, the controllers 230 coordinating execution by a handover of ALIGNMENT data over a communications link 1100; and
- in FIG. 11D, multiple weapons 203, each equipped with a respective alignment sensor 215, are aligned to a respective targeting sensor 210 by a respective controller 230, the controllers 230 each being slaved to a master controller 1103.

Note that, in each of these embodiments, only two weapons are shown even though the invention may theoretically be employed with any number of weapons. Also, each of these embodiments is disclosed with the same type of weapon even though some embodiments may employ weapons of different types within the same architecture. Those skilled in the art having the benefit of this disclosure may also realize other, alternative embodiments through similar such extrapolations.

Figure 12:
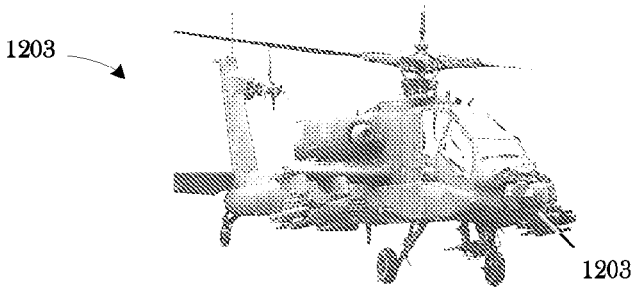
FIG. 12 depict an Apache helicopter such as may be retrofitted with the present invention.

The present invention may find application on platforms other than those presented and may be retrofitted onto some existing platforms. One such platform is the AH-64 Apache helicopter 1200 currently deployed by the United States Armed Forces, shown in FIG. 12. The Apache helicopter 1200 is armed with a 30 mm M230 chain gun 1203 that is slaved to the gunner's helmet-mounted gunsight (not shown). The present invention can be retrofitted onto the Apache helicopter 1200 by mounting an alignment sensor 215 to the chain gun 1203 and a targeting sensor 210 to the gunner's helmet. The modifications to the hardware and software architectures of the weapon system of the Apache helicopter 1200 will be readily apparent and implementable for those skilled in the art having the benefit of the present disclosure.

Those in the art will also recognize other platforms and weapon systems to which the present invention may be retrofitted.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An automated method for engaging a target, comprising:

slewing a weapon to an estimated target state; and aligning the slewed weapon's boresight with the actual target state, including:

determining the actual target state; and zeroing an offset between the actual target state and an estimated target state.

2. The automated method of claim 1, wherein determining the actual target state includes designating the target to obtain the actual target state.

3. The automated method of claim 2, wherein designating the target includes:

spotting the target from the estimated target state; and receiving the spotting of the target.

4. The automated method of claim 3, further comprising identifying the target.

5. The automated method of claim 1, wherein slewing the weapon includes slewing a gun system.

6. The automated method of claim 1, wherein zeroing the offset includes retrieving an angle correction corresponding to the offset from a look-up table.

7. The automated method of claim 1, wherein zeroing the offset includes computing the angle corrections corresponding to the offset.

8. The automated method of claim 1, further comprising iterating the weapon's alignment as the actual target state changes over time.

9. The automated method of claim 1 wherein the method is applied in a cooperative firing context.

10. An apparatus, comprising:

means for slewing a weapon to an estimated target state; and means for aligning the slewed weapon's boresight with the actual target state, the aligning including:

determining the actual target state; and zeroing an offset between the actual target state and the estimated target state; and means for controlling the slewing and the aligning.

11. The apparatus of claim 10, wherein slewing the weapon includes slewing a gun system.

12. The apparatus of claim 10, wherein determining the actual target state includes designating the target to obtain the actual target state.

13. The apparatus of claim 12, wherein designating the target includes:

spotting the target from the estimated target state; and receiving the spotting of the target.

14. The apparatus of claim 10, wherein zeroing the offset includes retrieving an angle correction corresponding to the offset from a look-up table.

15. The apparatus of claim 10, wherein zeroing the offset includes zeroing servo-motor commands responsive to the offset until the offset zeros.

16. The apparatus of claim 10, further comprising means for iterating the weapon's alignment as the actual target state changes over time.

* * * * *